US005493731A

United States Patent [19]

Amnott

[11] Patent Number: 5,493,731

[45] Date of Patent: Feb. 27, 1996

[54] NECKTIE ACCESSORY

[76] Inventor: James Amnott, 112 Harding St., Medfield, Mass. 02052

[21] Appl. No.: 58,926

[22] Filed: May 10, 1993

[51] Int. Cl.[6] ..... A41D 25/02

[52] U.S. Cl. ..... 2/148; 2/149; 2/150; 2/152.1; 2/153

[58] Field of Search ..... 2/144, 145, 148, 2/149, 150, 152.1, 152, 153; 24/49 R, 49 T, 49 S

[56] References Cited

U.S. PATENT DOCUMENTS

| | | | |
|---|---|---|---|
| 364,017 | 5/1889 | Irwin . | |
| 407,811 | 7/1889 | Bruce . | |
| 552,818 | 1/1896 | Camillo | 2/150 |
| 696,363 | 3/1902 | Fleisch . | |
| 2,148,154 | 2/1939 | Garfunkle | 2/155 X |
| 2,244,692 | 6/1941 | Hall | 2/150 |
| 2,714,719 | 8/1955 | Peake | 2/153 |
| 3,364,500 | 1/1968 | Fox | 2/150 |
| 3,526,004 | 9/1970 | Brandenberger | 2/150 |
| 3,745,614 | 7/1973 | Tsang | 24/153 |
| 3,958,277 | 5/1976 | Girdler | 2/153 |
| 4,283,797 | 8/1981 | Seider | 2/151 |
| 4,504,979 | 3/1985 | Kawamura | 2/153 |
| 4,625,339 | 12/1986 | Peters | 2/160 |
| 4,748,692 | 6/1988 | Fukushima | 2/152 R |
| 4,912,814 | 4/1990 | McKenzie | 24/495 |
| 4,958,383 | 9/1990 | Thompson | 2/145 |
| 5,084,916 | 2/1992 | Austin | 2/149 |
| 5,218,722 | 6/1993 | Vandenberg | 2/145 |

FOREIGN PATENT DOCUMENTS

| | | | |
|---|---|---|---|
| 148958 | 11/1952 | Australia | 2/153 |
| 0515846 | 12/1992 | European Pat. Off. | 2/148 |
| 560681 | 6/1930 | Germany | 2/150 |
| 0680765 | 11/1992 | Switzerland | 2/148 |
| 486404 | 6/1938 | United Kingdom | 2/149 |
| WO79/00 | 8/1994 | WIPO . | |

*Primary Examiner*—Jeanette E. Chapman
*Attorney, Agent, or Firm*—Ellen C. Childress

[57] ABSTRACT

A necktie assembly having a simulated knot which is slideable is disclosed. The simulated knot has a relatively rigid body and a Y-shaped bore. In one embodiment, the necktie is furnished with a complimentary image.

6 Claims, 7 Drawing Sheets

NECKTIE ACCESSORY

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

This invention relates to artificial knot structures and necktie assemblies.

BACKGROUND OF THE INVENTION

Tradition says the necktie originated in Croatia. Proper tying requires a certain amount of skill if the tie is to be both comfortable and look good. As a result, many accessories have been developed to offer alternative knotting arrangements, adjustment, and "neckties".

U.S. Pat. No. 364,017 shows a necktie in the form of a scarf with a binding strip to hold it to a neck band.

U.S. Pat. No. 407,811 shows a similar tie with the binding strip sewn in place, and the neck band buttoned to the collar.

U.S. Pat. No. 696,363, incorporated herein by reference, shows a necktie commonly tied in the manner of a four-in-hand or Windsor Style of knot. A small piece of cloth wrapped around the tie simulates a knot.

U.S. Pat. No. 3,364,500 shows a slide for a bolo tie, having 2 channels, one for each strand end.

U.S. Pat. No. 3,526,004 shows a removable knot having a top and a bottom opening.

U.S. Pat. No. 3,745,614 shows a hinged removable tie knot which has a separation means accessible when the knot is open.

U.S. Pat. No. 4,748,692 shows a necktie with a knot shaped member which has a hook to provide clearance between divided end sections when closed.

U.S. Pat. No. 4,958,383 shows a cloth slider which simulates a Windsor knot wrapped around a necktie attached to two strips of cloth which button onto a neck band.

U.S. Pat. No. 5,084,916 shows a necktie held in place by front and rear tienot shells, a slide bar and a lock.

WO 79/00894 shows a simulated knot having a two piece shell which is hinged and covered by a keeper.

It is desirable to have a slideable necktie knot which can be made as one piece which looks attractive, and is easy to use.

SUMMARY OF THE INVENTION

A tie assembly having a slideable simulated knot is disclosed. The simulated knot has two bores in the upper surface which connect with a single bore in the lower surface to form a generally Y or U shaped branched bore. The simulated knot may be formed as two or more pieces, however, a unitary construction is preferred. Angling the upper bores aids in proper placement of the tie. The tie of the assembly works best if it is somewhat shortened and may be provided with an image integrated with the simulated knot.

DETAILED DESCRIPTION OF THE INVENTION.

Figure 1:
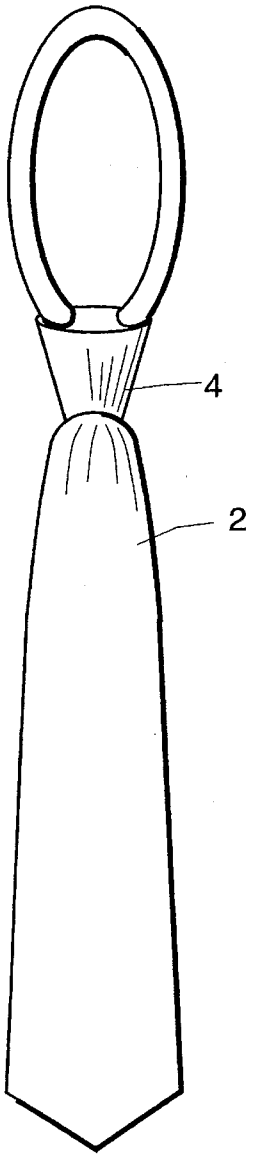
FIG. 1 is a perspective view of a tie assembly.

A necktie (2) is commonly an elongated strip of material having a back portion (36), a slightly broader front portion (40), and a neck portion connecting said back and front portions. FIG. 1 shows a necktie assembly according to the invention having a tie (2) and simulated knot (4).

Figure 2:
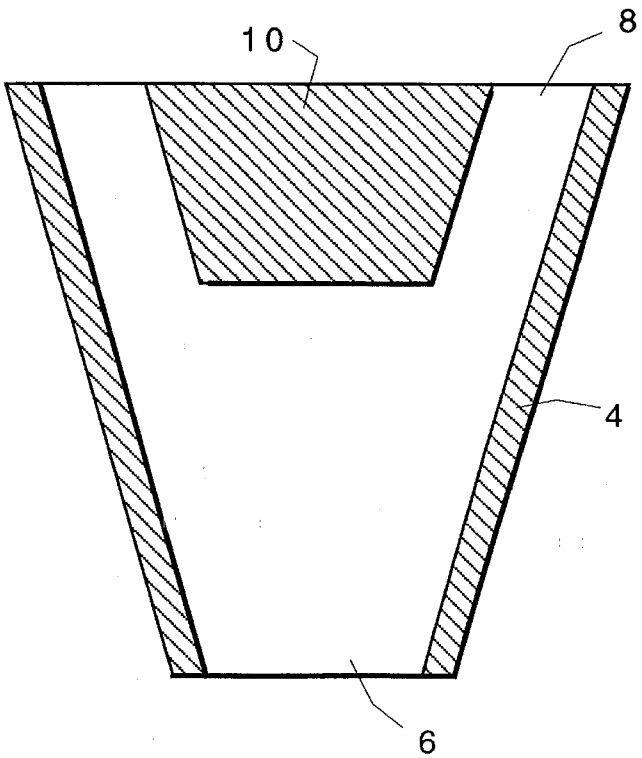
FIG. 2 is a cross sectional view of a simulated knot having a generally U shaped bore.

FIG. 2 Shows a cross section of a simulated knot (4). The body (10) is made from a relatively rigid material such as wood, rubber, polymer, metal, ceramic, a composite, or a combination of such materials. The upper end is provided with two bores (8) which connect into a larger bore (6) in the lower end, to form a U Shaped bore.

Figure 3:
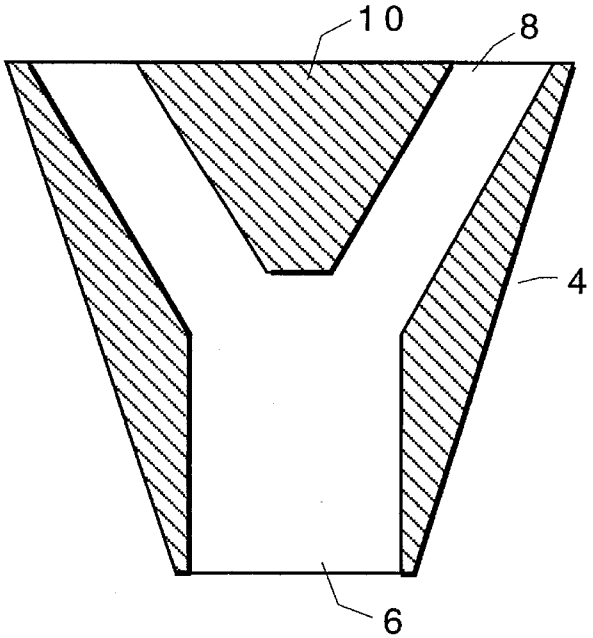
FIG. 3 is a cross sectional view of a simulated knot having a generally Y shaped bore.

FIG. 3 shows an alternative arrangement of bores which form a Y Shape.

Figure 4:
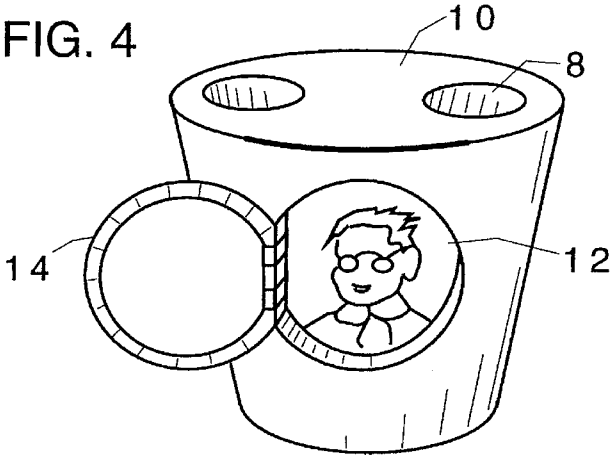
FIG. 4 is a unitary simulated knot with a covered recess.

The simulated knot of FIG. 4 has a recess (12) and hinged cover (14). Such recesses can be used for holding photographs as shown or an emergency coin.

Figure 5:
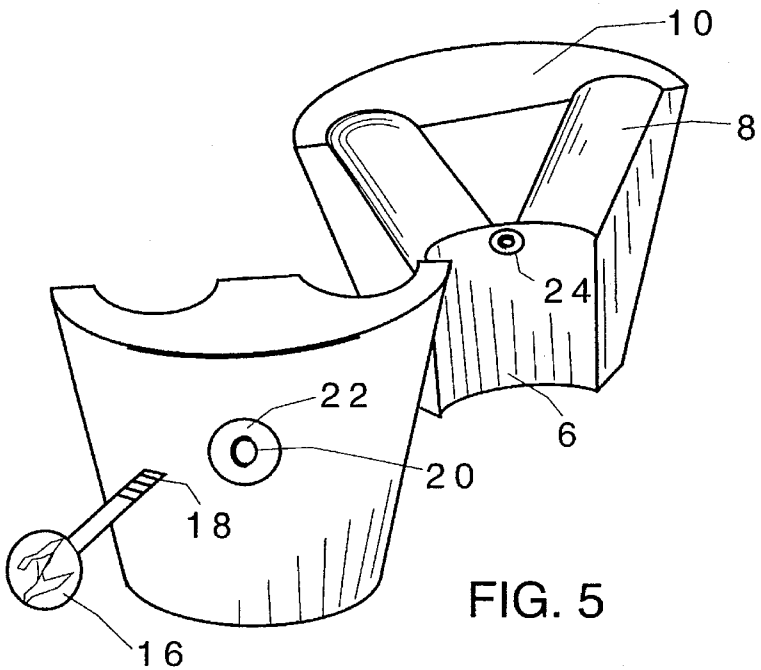
FIG. 5 is a two section simulated knot.

FIG. 5 shows a simulated knot having a front knot portion, a rear knot portion, and a pin (16). The pin (16) has decorative head and threaded stem (18). The front knot portion has a recess (22) for the head and an aperture (20) for the threaded stem (18). The rear knot portion has a threaded aperture (24) for securing the pin (16).

Figure 10A:
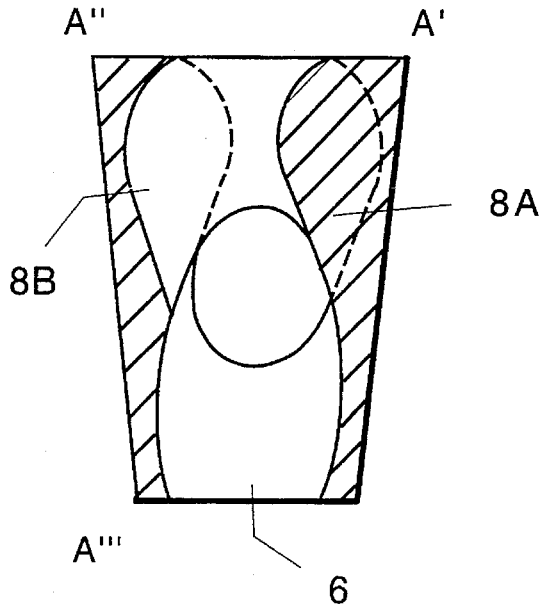
FIGS. 10A, B and C are a perspective, cross sectional and top views of a unitary simulated knot.
Figure 10B:
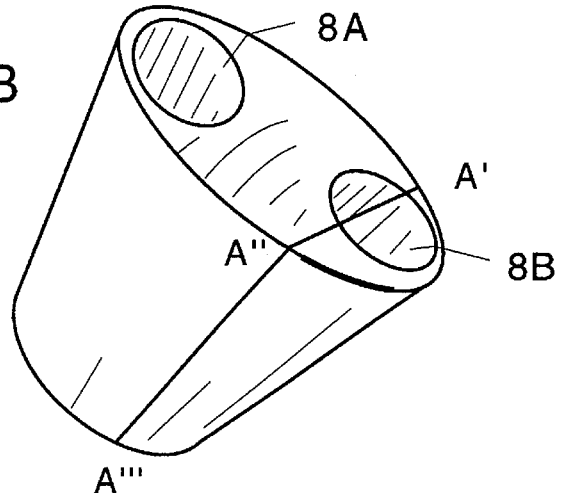
Figure 10C:
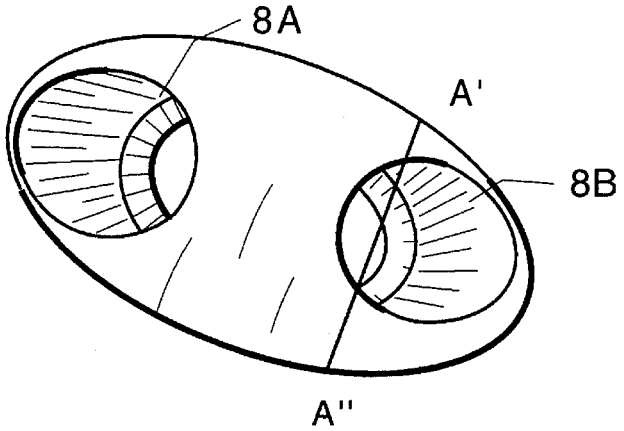

FIGS. 10B and C show perspective and top views of a unitary simulated knot (4). FIG. 10A is a cross sectional view taken along a plane defined by A'A"A'". First upper bore (8B) holds the necktie between the front portion (40) and the vertical axis, and is angled somewhat forward of the vertical axis of the simulated knot (4). Second upper bore (8*a*) holds the necktie between the back portion (36) and the neck portion, and is angled somewhat backward of the vertical axis of the simulated knot (4).

Figure 9:
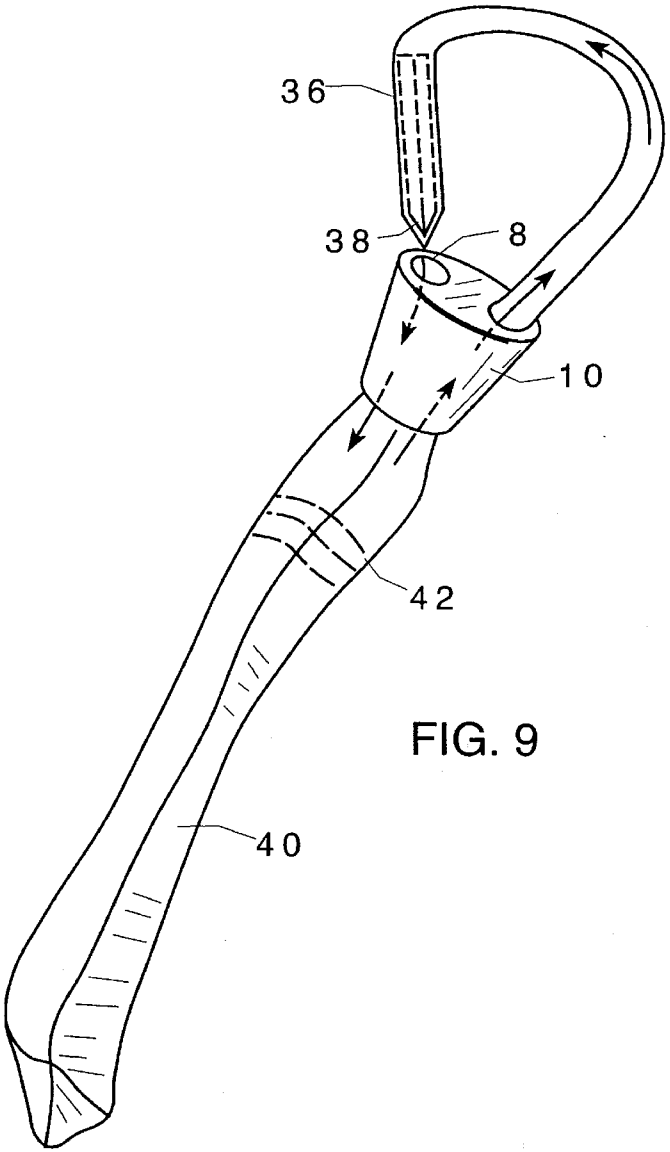
FIG. 9 shows threading of the simulated knot.

To assemble a necktie into a simulated (4) knot, the back portion (36) is threaded up through the lower bore (6) and then through the forward angled first upper bore (8*b*). The tie is pulled through these bores until the front tie (40) is located at the desired length. If desired, the backside of the front portion (40) may be provided with markings (42), so the wearer can locate the best fit. When the tie front (40) is located at the desire position, the back tie portion (36) is threaded through the rearward angled second upper bore (*8a*) and then through the lower bore (6) as shown in FIG. 9. The bulk of the cloth tie holds the front tie portion (40) in place, and the rearward angle guides the back tie portion (36) properly behind the front tie portion (40). With the neck portion large enough to loop over the head, the tie is placed over the head and adjusted for comfort with the rear tie portion (40).

Figure 11B:
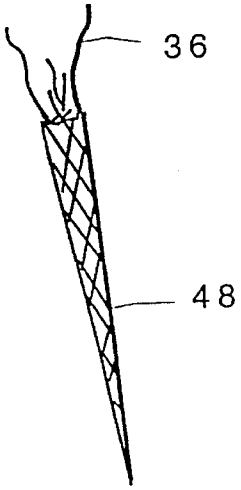
FIG. 11 shows an aid for threading the tie.
Figure 11A:
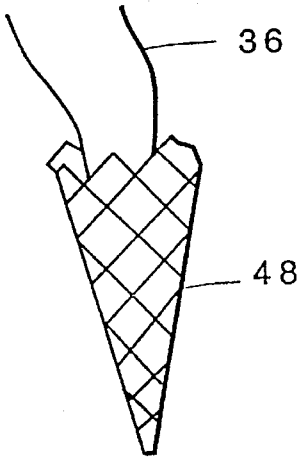
Figure 13:
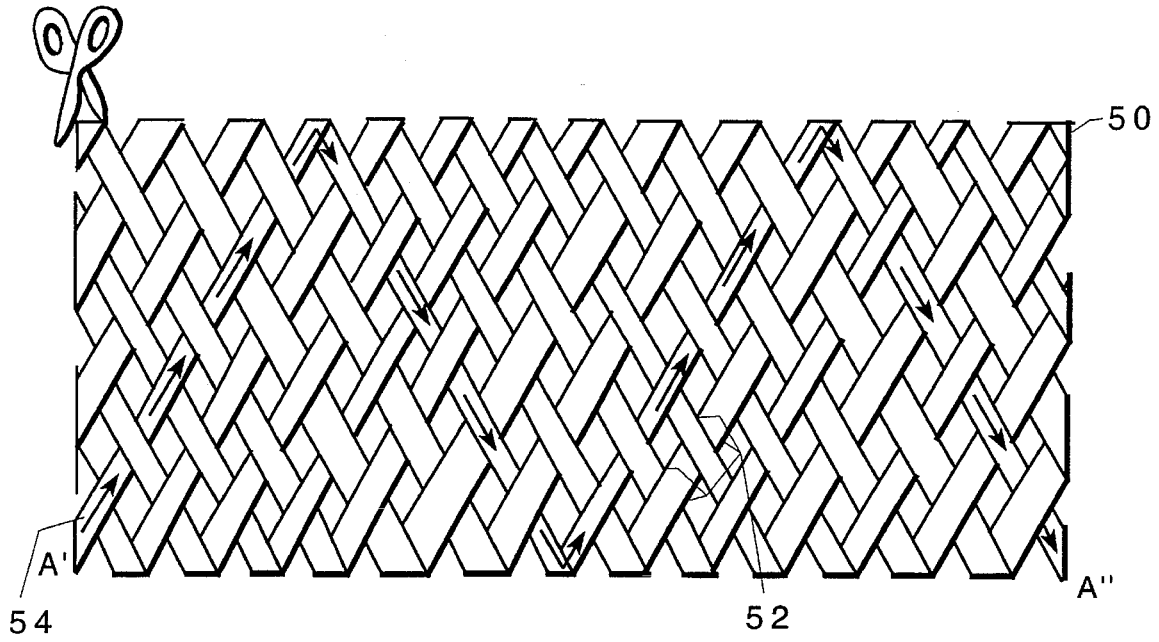
FIG. 13 shows a "Chinese Finger Trap" which has been cut and opened.
Figure 14:
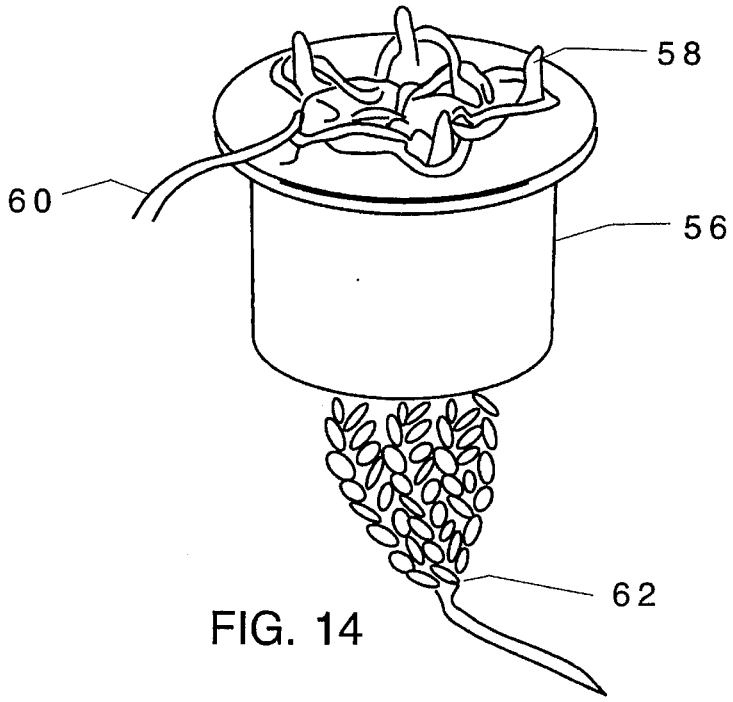
FIG. 14 shows a spool knitter for forming a tapered contracting threader.

To ease insertion of the end of the rear portion (36) through the bores, it is desirable to stiffen it and fold or roll it. One way of doing this is to have a tab (38) of a stiff yet flexible or foldable material such as cardboard, a thin sheet of plastic which can be inserted in end of the tie and then folded or curled to form a thin stiff member for guiding through bores. An alternative aid for guiding the tie end is to place the tie end into a channel, the walls of which define a narrower channel when the channel is extended lengthwise. One such channel is a child's amusement (50) which is a woven cylinder which narrows in diameter when lengthened. FIG. 13 shows the weaving of such a device, after it has been cut through the wall and spread out. Sections of stiff yet flexible material such as craft straw are woven in the pattern shown. The path of one section (54) is indicated along with the overlapped end (52) which forms a continuous strip. Before cutting A' and A" were touching. An alternative form is shown shown in FIGS. 11A and B. A conical shape (48) is woven by either adjusting the end angles of the tie or knot support, splitting the straws and or weaving them directly into the opposing face of the cone. The end of tie is inserted into the cone (48). The cone (48) is then elongated and tightens around and compresses the end for easy threading. After threading, the top and bottom of the cone (48) are pressed together, and the cone can easily be removed. Spool knitting shown in FIG. 14 can also be used to form a somewhat conical device from the craft straw. One end of the straw (62) is passed through the spool (56) and the other end is wrapped and hooked over projections (58) to form a knit cylinder with a tapered end.

Figure 6:
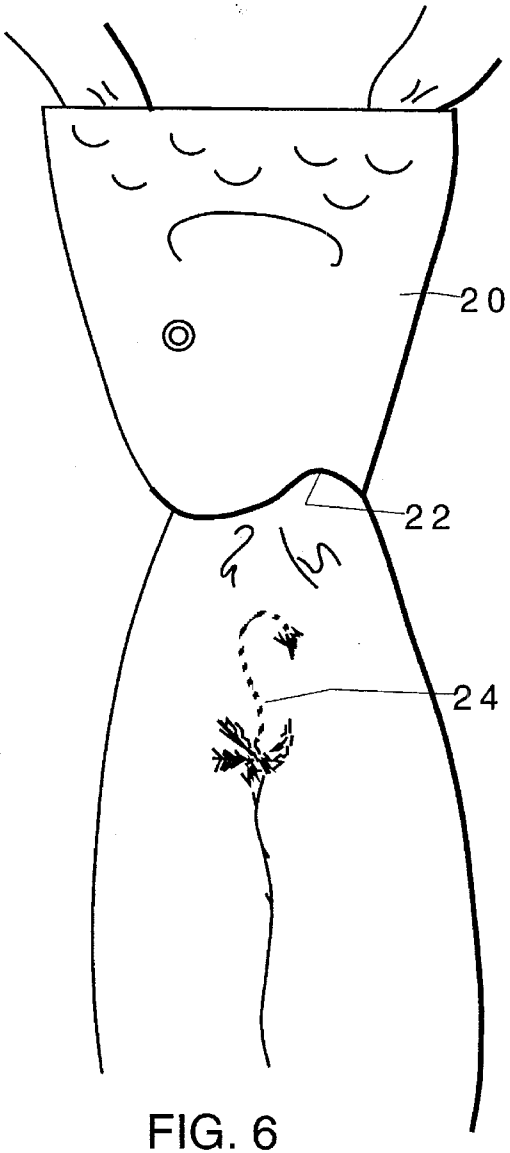
FIG. 6 is a detail of a tie assembly having an animal head simulated knot and integrated tie image.

Because the front portion of the tie can be placed with accuracy and precision, it becomes practical to integrate knot and necktie designs. One such design is shown in FIG. 6. The simulated knot (4) forms a fish head (20) having a mouth (22) at the lower end. The tie has a fly (24) embroidered into it. Alternatively, a series of fish, each eating a smaller fish could be shown.

Figure 7:
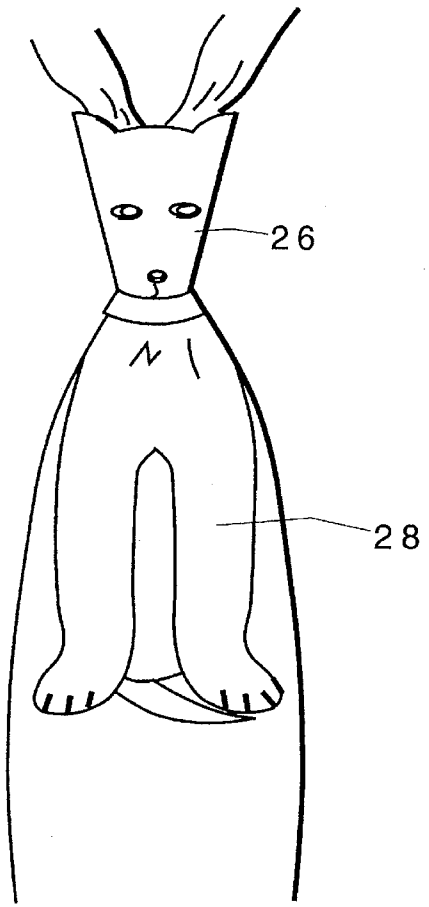
FIG. 7 is a detail of a tie assembly having an animal head simulated knot and a body integrated tie image.

In FIG. 7, the simulated knot is in the form of a dog head (26), and the integrated design a body (28).

Figure 8:
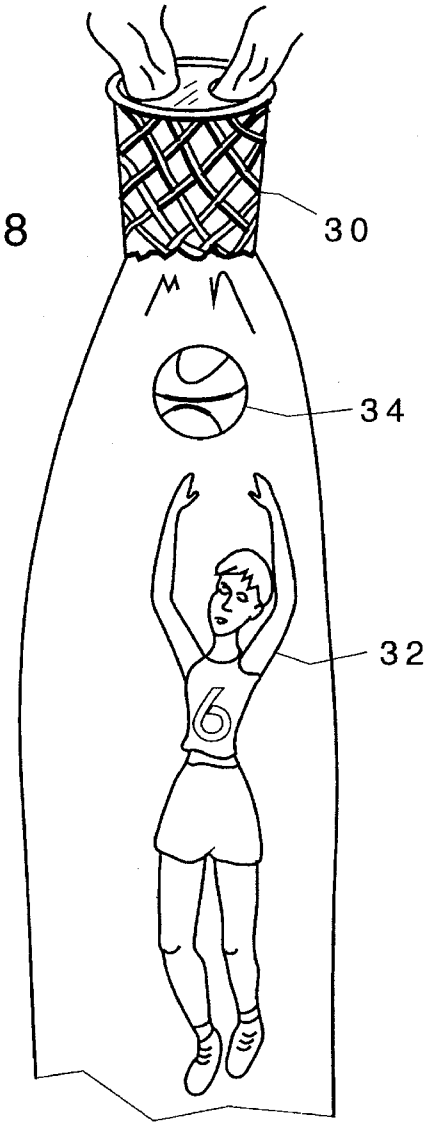
FIG. 8 is a detail of a tie assembly having a sporting equipment simulated knot, and an integrated tie image.

In FIG. 8, the simulated knot is made in the form of sports equipment, in this case a basketball hoop (30). The integrated design shows a player (32), and a tie tack in the form of a basketball (34).

Figure 12:
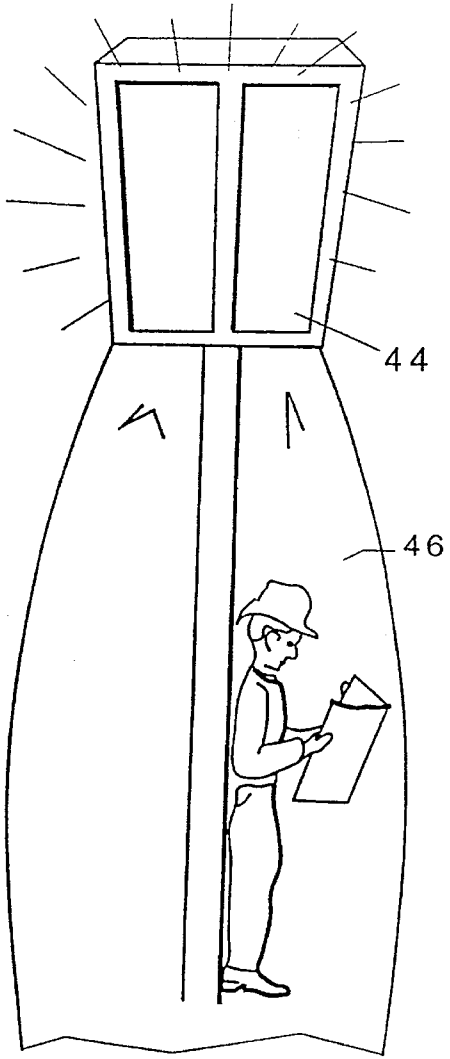
FIG. 12 shows a tie assembly having a street light scene.

In FIG. 12, the simulated knot is in the form of a street lamp (44), and the integrated image is a street scene (46). By use of a translucent plastic, and small light and battery, such as is available in small novelty pins, the lamp (44) could be made to glow or blink.

Since extra length to form a knot is not required, ties can be 10 to 15 cm shorter. The smaller rear portion (36) would ideally be provided with an 8 cm tapered portion which can be compressed to 1 cm in width or diameter. The taper portion is ideally stiffened.

The forward angled upper bore (8A) is preferably between 1.2 and 4 cm in length, and from 0.9 to 1.7 cm in diameter. The rearward angled upper bore (8B) is preferably between 1.2 and 5 cm in length and from 0.75 to 1.3 cm in diameter. The lower bore (6) is preferably from 1.2 to 6 cm in length and be oval or oblong in shape. The long dimension can be from 1.2 to 3.8 cm in length, and the shorter dimension from 1 to 2.5 cm in length.

Thematic choices for integrated designs of the necktie assemblies are sports such as: archery, baseball, basketball, bobsledding, bowling, boxing, diving, bungee-jumping, fishing, football, gold, gymnastics, handball, hockey, hunting, jai-alai, kayaking, lacrosse, orienteering, polo, racing, racquetball, rugby, rodeos, skating, skiing, swimming, shooting, tennis, track and field, weight lifting and wrestling, boating, bicycling, hang-gliding, flying, hiking, jogging, kites, climbing, parachuting, skydiving, horses, skate boarding, scuba, and water skiing; hobbies and careers such as: TV, cards and board games, chess, dancing, coin and stamp collecting, gambling, spelunking, trucking, motorcycling, snowmobiling, military, medical, legal, dental, teaching, financial, manufacturing, entertaining, music, computers, food, automotive service, travel, cleaning, farming, public service, organizations, and ecology items; people, places and things: such as photoimaged knots with photoscreen printed bodies, animals such as mammals, reptiles, birds, and amphibians, sign language, mathematics and chemistry, architecture, geology, space, politics, flowers, and hats.

The relatively rigid body and angled split bore of the simulated knot provide a necktie accessory which is easy to use, simple to manufacture, and allows for precise placement of integrated designs.

What is claimed is:

1. A slidable simulated knot comprising:

a relatively rigid body having a front, a back, first and second side surfaces, a top and a bottom;

first and second bores in said top;

a bore in said bottom, having a vertical axis running from said top to said bottom, whereby said top bores connect with said bottom bore to form a branched bore, wherein said first and second bores in said top branch extend from said bore in said bottom toward said first and second side surfaces in said top, wherein the combination of said first and second bores in said top and said bottom bore form a branched cross section if viewed from the front of the knot and unbranched cross sections from the side of the knot, wherein at least one of said top bores is angled backward from the vertical axis of said bore in said bottom of said body.

2. The knot of claim 1 wherein said first bore is angled forward of said vertical axis and said second bore is angled rearward of said vertical axis.

3. The knot of claim 2 wherein said body is unitary.

4. The knot of claim 2 wherein said body has a generally trapezoidal profile.

5. The knot of claim 2 wherein said forward angled upper bore is between 1.2 and 5 cm in length, and from 0.9 to 1.7 cm in diameter;

said rearward angled upper bore is between 1.2 and 5 cm in length and from 0.75 to 1.5 cm in diameter;

said lower bore is preferably from 1.2 to 6 cm long and oblong in shape having a long dimension of 1.2 to 3.8 cm, and a short dimension of 1 to 2.5 cm.

6. A slidable simulated knot comprising:

a relatively rigid body having a front, a back, first and second side surfaces, a top and a bottom;

first and second bores in said top; and a bore in said bottom having a vertical axis running from said top to said bottom, whereby said top bores connect with said bottom bore to form a branched bore, wherein said first and second bores in said top branch extend from said bore in said bottom toward said first and second side surfaces in said top, wherein said first top bore is angled backward from the vertical axis and wherein said second bore is angled forward of said vertical axis and wherein said body is unitary, and wherein said body further comprises a covered recess in one of said surfaces.

* * * * *